US010233523B2

(12) United States Patent
Nishiyama et al.

(10) Patent No.: US 10,233,523 B2
(45) Date of Patent: Mar. 19, 2019

(54) CARBURIZATION RESISTANT METAL MATERIAL

(75) Inventors: Yoshitaka Nishiyama, Nishinomiya (JP); Hirokazu Okada, Kobe (JP); Takahiro Osuki, Nishinomiya (JP); Etsuo Dan, Amagasaki (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 758 days.

(21) Appl. No.: 14/129,137

(22) PCT Filed: May 29, 2012

(86) PCT No.: PCT/JP2012/063696

§ 371 (c)(1),
(2), (4) Date: Dec. 24, 2013

(87) PCT Pub. No.: WO2012/176586

PCT Pub. Date: Dec. 27, 2012

(65) Prior Publication Data

US 2014/0127073 A1 May 8, 2014

(30) Foreign Application Priority Data

Jun. 24, 2011 (JP) ..... 2011-139994

(51) Int. Cl.

| | |
|---|---|
| ***C22C 38/02*** | (2006.01) |
| ***C22C 38/42*** | (2006.01) |
| ***C22C 38/58*** | (2006.01) |
| ***C22C 30/02*** | (2006.01) |
| ***C22C 38/00*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C21D 6/00*** | (2006.01) |
| ***C22C 38/34*** | (2006.01) |
| ***C22C 38/46*** | (2006.01) |
| *F28F 21/08* | (2006.01) |

(52) U.S. Cl.

CPC ..... *C22C 38/58* (2013.01); *C21D 6/004* (2013.01); *C22C 30/02* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *F28F 21/083* (2013.01)

(58) Field of Classification Search

CPC ..... C22C 38/02; C22C 38/42
USPC ..... 148/327; 420/36, 40, 41, 45, 49, 582
See application file for complete search history.

(56) References Cited

U.S. PATENT DOCUMENTS

| | | | |
|---|---|---|---|
| 2004/0191109 | A1 | 9/2004 | Maziasz et al. |
| 2005/0045251 | A1 | 3/2005 | Nishiyama et al. |
| 2010/0034690 | A1 | 2/2010 | Nishiyama et al. |

FOREIGN PATENT DOCUMENTS

| | | | | |
|---|---|---|---|---|
| CN | 1463296 | | 12/2003 | |
| CN | 1576381 | | 2/2005 | |
| CN | 101370951 | | 2/2009 | |
| CN | 101946016 | | 1/2011 | |
| EP | 0 533 211 | | 3/1993 | |
| EP | 1498508 | | 1/2005 | |
| EP | 1637785 | A1 * | 3/2006 | ..... C22C 38/18 |
| EP | 2246454 | | 11/2010 | |
| JP | 52-42417 | | 4/1977 | |
| JP | 53-66832 | | 6/1978 | |
| JP | 53-66835 | | 6/1978 | |
| JP | 56-93860 | | 7/1981 | |
| JP | 57-43989 | | 3/1982 | |
| JP | 57-171651 | | 10/1982 | |
| JP | 01-21038 | | 1/1989 | |
| JP | 02-170946 | | 7/1990 | |
| JP | 04-346638 | | 12/1992 | |
| JP | 09-78204 | | 3/1997 | |
| JP | 10-18004 | | 1/1998 | |
| JP | 11-29776 | | 2/1999 | |
| JP | 11-172473 | | 6/1999 | |
| JP | 2000-509105 | | 7/2000 | |
| JP | 2002-256398 | | 9/2002 | |
| JP | 2003-73763 | | 3/2003 | |
| JP | 2005-48284 | | 2/2005 | |
| JP | 2006-291290 | | 10/2006 | |
| JP | 2007-186727 | | 7/2007 | |
| JP | 2007-186728 | | 7/2007 | |
| RU | 2 125 110 | | 1/1999 | |
| RU | 2 149 210 | | 5/2000 | |
| RU | 2 210 603 | | 8/2003 | |
| RU | 2 281 345 | | 8/2006 | |
| WO | 2008/000740 | | 1/2008 | |
| WO | 2009/107585 | | 9/2009 | |

* cited by examiner

*Primary Examiner* — Brian D Walck
(74) *Attorney, Agent, or Firm* — Clark & Brody

(57) ABSTRACT

There is provided a carburization resistant metal material suitable as a raw material for cracking furnaces, reforming furnaces, heating furnaces, heat exchangers, etc. in petroleum and gas refining, chemical plants, and the like. This metal material consists of, by mass %, C: 0.03 to 0.075%, Si: 0.6 to 2.0%, Mn: 0.05 to 2.5%, P: 0.04% or less, S: 0.015% or less, Cr: higher than 16.0% and less than 20.0%, Ni: 20.0% or higher and less than 30.0%, Cu: 0.5 to 10.0%, Al: 0.15% or less, Ti: 0.15% or less, N: 0.005 to 0.20%, and O (oxygen): 0.02% or less, the balance being Fe and impurities. The metal material may further contain one kind or more kinds of Co, Mo, W, Ta, B, V, Zr, Nb, Hf, Mg, Ca, Y, La, Ce and Nd.

8 Claims, No Drawings

CARBURIZATION RESISTANT METAL MATERIAL

TECHNICAL FIELD

The present invention relates to a metal material that has excellent high-temperature strength and superior corrosion resistance, and in particular is used in a carburizing gas atmosphere containing hydrocarbon gas and CO gas. More particularly, it relates to a metal material having excellent weldability and metal dusting resistance, which is suitable as a raw material for cracking furnaces, reforming furnaces, heating furnaces, heat exchangers, etc. in petroleum and gas refining, chemical plants, and the like.

BACKGROUND ART

Demand for clean energy fuels such as hydrogen, methanol, liquid fuels (GTL: Gas to Liquids), and dimethyl ether (DME) is expected to significantly increase in the future. Therefore, a reforming apparatus for producing such a synthetic gas tends to be large in size, and an apparatus that achieves higher thermal efficiency and is suitable for mass production is demanded. Also, heat exchange for recovering exhaust is often used to enhance energy efficiency in reforming apparatuses in the conventional petroleum refining, petrochemical plants, and the like, and ammonia manufacturing apparatuses, hydrogen manufacturing apparatuses, and the like, in which raw materials such as petroleum are used.

To effectively use the heat of such a high-temperature gas, heat exchange in a temperature range of 400 to 800° C., which is relatively low, has become important, and corrosion caused by carburization of a high Cr-high Ni—Fe alloy based metal material used for reaction tubes, heat exchangers, and the like in this temperature range poses a problem.

Usually, a synthetic gas reformed in the above-described reactors, that is, a gas containing $H_2$, CO, $CO_2$, $H_2O$, and hydrocarbon such as methane comes into contact with the metal material of a reaction tube and the like at a temperature of about 1000° C. or higher. In this temperature range, on the surface of the metal material, elements such as Cr and Si, which have higher oxidation tendency than Fe or Ni or the like, are oxidized selectively, and a dense film of chromium oxide or silicon oxide or the like is formed, by which corrosion is restrained. In a portion such as a heat exchange part in which the temperature is relatively low, however, the diffusion of element from the inside to the surface of metal material is insufficient. Therefore, the formation of oxide film, which achieves a corrosion restraining effect, delays, and additionally, such a gas having a composition containing hydrocarbon comes to have carburizing properties, so that carbon intrudes into the metal material through the surface thereof, and carburization occurs.

In an ethylene cracking furnace tube and the like, if carburization proceeds and a carburized layer comprising carbide of Cr or Fe or the like is formed, the volume of that portion increases. As a result, fine cracks are liable to develop, and in the worst case, the tube in use is broken. Also, if the metal surface is exposed, carbon precipitation (coking) in which metal serves as a catalyst occurs on the surface, so that the flow path area of the tube decreases and the heat-transfer characteristics degrade.

In a heating furnace tube and the like for a catalytic cracking furnace for increasing the octane value of naphtha obtained by distillation of crude oil as well, a heavily carburizing environment consisting of hydrocarbon and hydrogen is created, so that carburization and metal dusting occur.

On the other hand, in an environment in which the carburizing properties of gas in the reforming furnace tube, heat exchanger, and the like are severer, the carbide is supersaturated, and thereafter graphite precipitates directly. Therefore, a base material metal is exfoliated away and the thickness of base material decreases, that is, corrosion loss called metal dusting proceeds. Further, coking occurs with the exfoliated metal powder serving as a catalyst.

If the cracks, loss, and in-tube closure increase, an apparatus failure or the like occurs. As a result, operation may be suspended. Therefore, careful consideration must be given to the selection of material used for an apparatus member.

To prevent the aforementioned carburization and the corrosion caused by metal dusting, various countermeasures have conventionally been studied.

For example, Patent Document 1 proposes an Fe-based alloy or a Ni-based alloy containing 11 to 60% (mass %, the same shall apply hereinafter) of Cr concerning the metal dusting resistance in an atmospheric gas of 400 to 700° C. containing $H_2$, CO, $CO_2$ and $H_2O$. Specifically, it is shown that the invention of an Fe-based alloy containing 24% or more of Cr and 35% or more of Ni, a Ni-based alloy containing 20% or more of Cr and 60% or more of Ni, and an alloy material in which Nb is further added to these alloys is excellent. However, even if a Cr or Ni content in the Fe-based alloy or the Ni-based alloy is merely increased, a sufficient carburization restraining effect cannot be achieved, so that a metal material having higher metal dusting resistance has been demanded.

Also, in a method disclosed in Patent Document 2, to prevent corrosion caused by metal dusting of a high-temperature alloy containing iron, nickel, and chromium, one or more kinds of metals of the VIII group, the IB group, the IV group, and the V group of the element periodic table and a mixture thereof are adhered to the surface by the ordinary physical or chemical means, and the alloy is annealed in an inert atmosphere to form a thin layer having a thickness of 0.01 to 10 μm, by which the alloy surface is protected. In this case, Sn, Pb, Bi, and the like are especially effective. Although effective at the early stage, this method may lose effectiveness in that the thin layer is exfoliated in long-term use.

Patent Document 3 relates to the metal dusting resistance of a metal material in an atmospheric gas of 400 to 700° C. containing $H_2$, CO, $CO_2$ and $H_2O$. As the result of an investigation of the interaction with carbon made from the viewpoint of solute element in iron, Patent Document 3 discloses that the addition of an element producing stable carbide in the metal material, such as Ti, Nb, V and Mo, or the alloying element in which the interaction co-factor Ω represents a positive value, such as Si, Al, Ni, Cu and Co is effective in restraining metal dusting in addition to enhancing the protecting properties of oxide film. However, the increase of Si, Al and the like sometimes leads to the decrease in hot workability and weldability. Therefore, considering the manufacturing stability and plant working, this metal material leaves room for improvement.

Next, to break off the contact of carburizing gas with the metal surface, there have been disclosed a method for oxidizing a metal material in advance and a method for performing surface treatment.

For example, Patent Document 4 and Patent Document 5 disclose a method for pre-oxidizing a low Si-based 25Cr-20Ni (HK40) heat resistant steel or a low Si-based 25Cr- 35Ni heat-resisting steel at a temperature near 1000° C. for 100 hours or longer in the air. Also, Patent Document 6 discloses a method for pre-oxidizing an austenitic heat-resisting steel containing 20 to 35% of Cr in the air. Further, Patent Document 7 proposes a method for improving the carburization resistance by heating a high Ni—Cr alloy in a vacuum and by forming a scale film.

Patent Document 8 proposes an austenitic alloy whose contents of Si, Cr and Ni satisfy the formula of Si<(Cr+0.15Ni−18)/10; thereby a Cr-based oxide film having high adhesiveness even in an environment, in which the alloy is subjected to a heating/cooling cycle, is formed to provide the alloy with excellent carburization resistance even in an environment in which the alloy is exposed to a corrosive gas at high temperatures. Patent Document 9 proposes an austenitic stainless steel having excellent scale exfoliation resistance even in an environment in which the steel is subjected to a heating/cooling cycle, which is produced by containing Cu and a rare earth element (Y and Ln group) therein and thereby forming a uniform oxide film having high Cr concentration in the film. In this patent document, however, the influence of Cu addition on the weldability or the creep ductility has not been studied. Patent Document 10 proposes a method for improving the carburization resistance by forming a concentrated layer of Si or Cr by performing surface treatment. Unfortunately, all of these prior arts require special heat treatment or surface treatment, and therefore they are inferior in economy. Also, since scale restoration (scale recycling) after the pre-oxidized scale or the surface treatment layer has exfoliated away is not considered, if the material surface is damaged once, the subsequent effect cannot be anticipated.

Patent Document 11 proposes a stainless steel pipe having excellent carburization resistance and containing 20 to 55% of Cr, which is produced by forming a Cr-deficient layer, which has a Cr concentration of 10% or higher and lower than the Cr concentration of the base material, on the surface of steel pipe. In this patent document, however, improvement has not been made at all on the decrease in weldability caused by containing Cr or the addition of Si. Also, Patent Document 12 proposes a metal material in which the HAZ crack susceptibility, which is one property of weldability, is decreased by increasing the content of C of an Si and Cu containing steel. This patent document, however, does not provide a drastic solution because the high C content increases the weld solidification crack susceptibility, and also decreases the creep ductility.

Besides, a method for adding $H_2S$ into the atmospheric gas has been thought of. However, the application of this method is restricted because $H_2S$ may remarkably decrease the activity of a catalyst used for reforming.

Patent Document 13 and Patent Document 14 propose a metal material in which the gas dissociative adsorption (gas/metal surface reaction) is restrained by containing a proper amount of one kind or more kinds of P, S, Sb and Bi. Since these elements segregate on the metal surface, even if the elements are not added excessively, the elements can restrain carburization and metal dusting corrosion significantly. However, since these elements segregate not only on the metal surface but also at the grain boundary of metal grainy, a problem associated with hot workability and weldability remains to be solved.

Techniques for enhancing corrosion resistance and crevice corrosion resistance by adding Cu have also been proposed. Patent Document 15 describes a technique for enhancing corrosion resistance by containing Cu, and on the other hand, for increasing the hot workability improving effect due to B by reducing S and O as far as possible. Patent Document 16 describes a technique for improving corrosion resistance and crevice corrosion resistance excellent in sulfuric acid and sulfate environments by setting the G.I. value (General Corrosion Index) represented by "—Cr+3.6Ni+4.7Mo+11.5Cu" at 60 to 90 and by setting the C.I. value (Crevice Corrosion Index) represented by "Cr+0.4Ni+2.7Mo+Cu+18.7N" at 35 to 50. Patent Document 17 describes a technique for improving hot workability by adding B exceeding 0.0015% while increasing a Cu content and by keeping an oxygen content low. In all of these techniques, the upper limit of a C content is restricted to a low level to avoid the decrease in corrosion resistance. Therefore, the solid-solution strengthening of C cannot be anticipated, and a sufficient high-temperature strength cannot be obtained. For this reason, these techniques are unsuitable for a metal material used at high temperatures.

CITATION LIST

Patent Documents

[Patent Document 1] JP9-78204A
[Patent Document 2] JP11-172473A
[Patent Document 3] JP2003-73763A
[Patent Document 4] JP53-66832A
[Patent Document 5] JP53-66835A
[Patent Document 6] JP57-43989A
[Patent Document 7] JP11-29776A
[Patent Document 8] JP2002-256398A
[Patent Document 9] JP2006-291290A
[Patent Document 10] JP2000-509105A
[Patent Document 11] JP2005-48284A
[Patent Document 12] WO 2009/107585 A
[Patent Document 13] JP2007-186727A
[Patent Document 14] JP2007-186728A
[Patent Document 15] JP1-21038A
[Patent Document 16] JP2-170946A
[Patent Document 17] JP4-346638A

SUMMARY OF INVENTION

Technical Problem

As described above, various techniques for enhancing the metal dusting resistance, the carburization resistance, and the coking resistance of metal material have been proposed conventionally. However, all of these techniques require special heat treatment and surface treatment, so that cost and labor are needed. Also, these techniques have no function of scale restoration (scale recycling) after the pre-oxidized scale or the surface treatment layer has exfoliated away. Therefore, if the material surface is damaged once, the subsequent metal dusting cannot be restrained. Also, these techniques have a problem associated with weldability of metal material, creep strength, and creep ductility.

Also, there is a method for restraining metal dusting by adding $H_2S$ into the atmospheric gas in the tube of a reforming apparatus and manufacturing apparatus for synthetic gas as described above, not by improving the metal material itself. However, since $H_2S$ may remarkably decrease the activity of a catalyst used for reforming hydrocarbon, the technique for restraining metal dusting by adjusting the components of atmospheric gas is merely applied limitedly.

The present invention has been made in view of the present situation, and accordingly an object thereof is to provide a metal material that has metal dusting resistance, carburization resistance, and coking resistance, and further has improved weldability and creep properties due to the restraint of reaction between carburizing gas and the metal surface in an ethylene plant cracking furnace tube, a heating furnace tube of catalytic reforming furnace, a synthetic gas reforming furnace tube, and the like.

Solution to Problem

The inventors analyzed a phenomenon that carbon intrudes into a metal in a molecular state, and revealed that this phenomenon progresses in an elementary process consisting of the following items (a) to (c).

(a) Gas molecules consisting of C compounds such as hydrocarbon and CO approach the metal surface.

(b) The approaching gas molecules are dissociatively adsorbed onto the metal surface.

(c) The dissociated atomic carbon intrudes into the metal and diffuses.

As the result of various studies on methods for restraining the aforementioned phenomenon, it was found that the following methods (d) and (e) are effective.

(d) Oxide scale is formed positively on the metal surface during the use of metal material, by which the contact with the metal of the gas molecules consisting of C compounds is broken off.

(e) The dissociative adsorption of the gas molecules consisting of C compounds is restrained on the metal surface.

As the result that the study on oxide scale having a breaking-off effect as in the item (d) was conducted, it was revealed that oxide scale consisting of Cr and Si acts effectively. In particular, in a carburizing gas environment such as an ethylene plant cracking furnace tube, a heating furnace tube of catalytic reforming furnace, and a synthetic gas reforming furnace tube, the partial pressure of oxygen in gas is low. Therefore, it was revealed that oxide scale consisting mainly of Cr can be formed on the gas side and oxide scale consisting mainly of Si can be formed on the metal side by containing proper amounts of Cr and Si.

On the other hand, as the result that the study was conducted from the viewpoint of dissociative adsorption as in the item (e), it was revealed that if proper amounts of noble metal elements such as Cu, Ag and Pt and elements of the VA group and the VIA group in the periodic table are added, an effect of restraining the dissociative adsorption of gas molecules consisting of C compounds is achieved. In particular, Cu is low in cost among the noble metal elements, and additionally less problems occur in melting and solidification when Cu is contained in an Fe—Ni—Cr based metal material. Therefore, the use of Cu is preferable.

It was revealed that according to the methods (d) and (e), the intrusion of carbon into the metal in the above-described elementary process of items (a) to (c) can be restrained effectively, and by applying the methods (d) and (e) simultaneously, the metal dusting resistance, the carburization resistance, and the coking resistance can be improved dramatically.

However, if an element such as Si and Cu is added, the corrosion resistance can be improved; on the other hand, the weldability is deteriorated. In particular, in a region subjected to an influence of heat cycle of rapid heating/rapid cooling caused by welding, that is in a welding heat affected zone (hereinafter, referred to as "HAZ"), cracks caused by grain boundary melting are liable to develop. Specifically, if Si, Cu or the like element segregates at the crystal grain boundary of the base material, the melting point of grain boundary lowers and the ductility decreases. As a result, the grain boundary is torn off by the thermal stress at the time of welding, which develops a crack. This is a HAZ crack. Therefore, in the case where the metal material is used for a welded structure, weld cracks of this kind must be restrained. In Patent Document 12, the present inventors precipitated Cr carbides having a high fusing point by containing much C. As a result, the grain boundary surface area was increased by restraining grain coarsening, and thereby the segregation of Si, Cu, and the like at the grain boundaries was reduced, whereby HAZ cracks were successfully suppressed. On the other hand, however, it was revealed that C is segregated between the solidification structure dendritic trees in the weld metal by containing much C, whereby the solidification crack susceptibility is raised. Further, it was revealed that the creep strength becomes too high by the precipitation of Cr carbides within the base metal grain and at the grain boundaries, resulting in poor creep ductility.

The inventors studied various methods capable of restraining HAZ cracks at the time of welding while improving the corrosion resistance by adding a considerable amount of Si or Cu again. As a result, the present inventors obtained findings that HAZ cracks can be suppressed without impairing the solidification crack susceptibility and creep ductility by the methods described in the following items (f) to (h).

(f) Since containing much C impairs the solidification crack susceptibility and creep ductility remarkably, the C content is restricted.

(g) The HAZ crack susceptibility is caused by the imbalance in strength between within the base metal grains and at the grain boundaries. Therefore, by decreasing the strength within the grains, the imbalance in strength within the grains is redressed relatively, and the HAZ crack susceptibility is improved.

(h) It is revealed that the portion within the grains is strengthened by the precipitation of an intermetallic compound of Al and Ti or TiC, and it is effective to restrict these elements in a possible range.

Based on these findings, the weldability (HAZ crack susceptibility, solidification crack susceptibility) and the creep properties were studied by changing the contents of C, Si, Cu, Ti and Al variously in a metal material containing 15.0 to 30.0% of Cr. As a result, the weldability and the creep ductility were improved by restricting the C content to 0.075% or less and by restricting the Ti content and the Al content each to 0.15% or less. Further, if the contents of C, Ti and Al were restricted to 0.07% or less, 0.05% or less, and 0.12% or less, respectively, the weldability and the creep ductility were improved remarkably.

However, it was newly revealed that the creep strength is also decreased as a result of the decrease in strength within the grains. Therefore, the present inventors aimed to increase the creep strength while the aforementioned performance improvement is maintained, and resultantly, obtained the findings that this problem can be solved by the method described in the following item (i).

(i) Cr is effective for metal dusting resistance, and on the other hand, decreases the creep strength with higher content. Therefore, to enhance the creep strength, it is effective to restrict the Cr content. The restriction of Cr content strengthens the austenitic microstructure itself of base metal, and therefore does not decrease the creep ductility unlike precipitation strengthening.

The present inventors examined the metal dusting resistance and, the creep properties by changing the Cr content variously, and resultantly, obtained the findings that if the Cr content is restricted to a range of higher than 16.0% and less than 22.0%, the desired properties can be assured.

(j) It was revealed that in order to further increase the creep ductility and the HAZ crack susceptibility, it is effective to make the crystal grain size of austenitic microstructure fine. That is, the surface area of grain boundary is increased by restraining the coarsening of the crystal grain, and thereby the segregation of Si, P, Cu or the like at the grain boundary can be decreased.

The present invention has been completed based on the above-described knowledge, and the gists of the present invention are as described in the following items (1) to (4).

(1) A carburization resistant metal material characterized by consisting of, by mass %, C: 0.03 to 0.075%, Si: 0.6 to 2.0%, Mn: 0.05 to 2.5%, P: 0.04% or less, S: 0.015% or less, Cr: higher than 16.0% and less than 20.0%, Ni: 20.0% or higher and less than 30.0%, Cu: 0.5 to 10.0%, Al: 0.15% or less, Ti: 0.15% or less, N: 0.005 to 0.20%, and O (oxygen): 0.02% or less, the balance being Fe and impurities.

(2) A carburization resistant metal material characterized by consisting of, by mass %, C: 0.04 to 0.07%, Si: 0.8 to 1.5%, Mn: 0.05 to 2.5%, P: 0.04% or less, S: 0.015% or less, Cr: 18.0% or higher and less than 20.0%, Ni: 22.0 to 28.0%, Cu: 1.5 to 6.0%, Al: 0.12% or less, Ti: 0.05% or less, N: 0.005 to 0.20%, and O (oxygen): 0.02% or less, the balance being Fe and impurities.

(3) The carburization resistant metal material described in item (1) or (2) above, characterized by further containing, by mass %, at least one kind of a component selected from at least one group of the first group to the fifth group described below:

first group: Co: 10% or less, second group: Mo: 5% or less, W: 5% or less, and Ta: 5% or less, third group: B: 0.1% or less, V: 0.5% or less, Zr: 0.5% or less, Nb: 2% or less, and Hf: 0.5% or less, fourth group: Mg: 0.1% or less and Ca: 0.1% or less, fifth group: Y: 0.15% or less, La: 0.15% or less, Ce: 0.15% or less, and Nd: 0.15% or less.

(4) The carburization resistant metal material described in any one of items (1) to (3), characterized by having a fine grain such that the austenite grain size No. is 6 or higher.

Advantageous Effects of Invention

The metal material in accordance with the present invention has an effect of restraining reaction between carburizing gas and the metal surface, and has excellent metal dusting resistance, carburization resistance, and coking resistance. Further, since the weldability and the creep ductility are improved, the metal material can be used for welded structure members of cracking furnaces, reforming furnaces, heating furnaces, heat exchangers, etc. in petroleum refining, petrochemical plants, and the like, and can significantly improve the durability and operation efficiency of apparatus.

In particular, the metal material in accordance with the present invention is suitable as a metal material used for reaction tubes and heat exchangers used for heat exchange in a temperature range of 400 to 800° C., which is lower than the conventional temperature range, so that metal dusting, which poses a problem in this temperature range, can be restrained effectively.

DESCRIPTION OF EMBODIMENTS (A) Concerning Chemical Composition of Metal Material The reason why the composition range of metal material is restricted according to the invention is as described below. In the explanation below, the "%" representation of the content of each element means "mass %".

C: 0.03 to 0.075%

C (carbon) is one of the most important elements in the present invention. Carbon enhances the strength at high temperatures in combination with chromium to form carbides. To this end, 0.03% or more of C must be contained. On the other hand, containing C raises the solidification crack susceptibility at the welding time, and decreases the creep ductility at high temperatures. To this end, the upper limit of C content is restricted to 0.075%. The C content is preferably in the range of 0.03% to 0.07%, more preferably in the range of 0.04% to 0.07%.

Si: 0.6 to 2.0%

Si (silicon) is one of important elements in the present invention. Since silicon has a strong affinity with oxygen, it forms Si-based oxide scale in the lower layer of a protective oxide scale layer such as $Cr_2O_3$, and isolates carburizing gas. This action is brought about when the Si content is 0.6% or higher. However, if the Si content exceeds 2.0%, the weldability decreases remarkably, so that the upper limit of Si content is set at 2.0%. The Si content is preferably in the range of 0.8 to 1.5%, more preferably in the range of 0.9 to 1.3%.

Mn: 0.05 to 2.5%

Mn (manganese) has deoxidizing ability and also improves the workability and weldability, so that 0.05% or more of Mn is added. Also, since Mn is an austenite-generating element, some of Ni can be replaced with Mn. However, excessive addition of Mn harms the carburizing gas isolating properties of protective oxide scale layer, so that the upper limit of Mn content is set at 2.5%. The Mn content is preferably in the range of 0.1 to 2.0%, more preferably in the range of 0.6 to 1.5%.

P: 0.04% or Less

P (phosphorus) decreases the hot workability and weldability, so that the upper limit of P content is set at 0.04%. In particular, when the Si and Cu contents are high, this effect is important. The upper limit of P content is preferably 0.03%, more preferably 0.025%. However, since phosphorus acts to restrain the dissociative adsorption reaction on the metal surface of carburizing gas, it may be contained when the decrease in weldability can be permitted.

S: 0.015% or Less

S (sulfur) decreases the hot workability and weldability like phosphorus, so that the upper limit of S content is set at 0.015%. In particular, when the Si and Cu contents are high, this effect is important. The upper limit of S content is preferably 0.005%, more preferably 0.002%. However, like phosphorus, since sulfur acts to restrain the dissociative adsorption reaction on the metal surface of carburizing gas, it may be contained when the decrease in weldability can be permitted.

Cr: Higher than 16.0% and Less than 20.0%

Cr (chromium) is one of the most important elements in the present invention. Cr forms oxide scale such as $Cr_2O_3$ stably, and has an effect of isolating carburizing gas. Therefore, even in a severe carburizing gas environment, chromium provides sufficient carburization resistance, metal dusting resistance, and coking resistance. In order to achieve this effect sufficiently, higher than 16.0% of Cr must be contained. On the other hand, Cr combines with C to form carbides, thereby decreasing the creep ductility. Also, containing Cr decreases the creep strength of austenitic microstructure. Especially when the contents of co-existing Si and Cu are high, this effect is great. In order to counter this adverse effect, the Cr content must be restricted to less than 20.0%. The range of Cr content is preferably 18.0% or higher and less than 20.0%, more preferably 18.0% or higher and less than 19.5%.

Ni: 20.0% or Higher and Less than 30.0%

Ni (nickel) is an element necessary for obtaining a stable austenitic microstructure according to the Cr content, and therefore 20.0% or more of Ni must be contained. Also, when carbon intrudes into the steel, nickel has a function of reducing the intrusion rate. Further, nickel acts to secure the high-temperature strength of the metal microstructure. However, the nickel content higher than necessary may lead to cost increase and manufacturing difficulties, and may also accelerate coking and metal dusting especially in a gas environment that contains hydrocarbon. Therefore, Ni content is restricted to less than 30.0%. The content of Ni is preferably in the range of 22.0 to 28.0%. More preferably, the content of Ni is in the range of 23.0 to 27.0%.

Cu: 0.5 to 10.0%

Cu (copper) is one of the most important elements in the present invention. Copper restrains reaction between carburizing gas and the metal surface, and greatly improves the metal dusting resistance and the like. Also, since copper is an austenite-generating element, some of Ni can be replaced with Cu. To achieve the metal dusting resistance improving effect, 0.5% or more of Cu must be contained. However, if Cu exceeding 10.0% is contained, the weldability decreases, so that the upper limit of Cu content is set at 10.0%. The Cu content is preferably 1.5 to 6.0%, more preferably 2.1 to 4.0%.

Al: 0.15% or Less

Al (aluminum) is an element effective in improving the creep strength due to precipitation strengthening; however, when the contents of co-existing Si and Cu are high, Al raises the HAZ crack susceptibility and further decreases the creep ductility. Also, in order to decrease the HAZ crack susceptibility, it is effective, as described above, to restrict the Al content to a possible range and to reduce the precipitation of metal compounds into the grains. Therefore, in the present invention, the Al content is restricted to 0.15% or less. The Al content is preferably 0.12% or less, more preferably 0.10% or less. Since Al acts effectively as a deoxidizing element at the melting time, in the case where it is desired to achieve this effect, 0.005% or more of Al is preferably contained.

Ti: 0.15% or Less

Ti (titanium) is an element effective in improving the creep strength due to precipitation strengthening; however, when the contents of co-existing Si and Cu are high, Ti raises the HAZ crack susceptibility and further decreases the creep ductility. Also, in order to decrease the HAZ crack susceptibility, it is effective, as described above, to restrict the Ti content to a possible range and to reduce the precipitation of metal compounds and carbides into the grains. Therefore, in the present invention, the Ti content is restricted to 0.15% or less. The Ti content is preferably 0.08% or less, more preferably 0.05% or less. In the case where it is desired to achieve the creep strength improving effect brought about by Ti, 0.005% or more of Ti is preferably contained.

N: 0.005 to 0.20%

N (nitrogen) has an action for enhancing the high-temperature strength of metal material. Further, since N combines with elements such as Nb and Ta to form a Z phase, N decreases the HAZ crack susceptibility. These effects are achieved by containing 0.005% or more of N. However, if the N content exceeds 0.20%, the workability is impaired. Therefore, the upper limit of N content is set at 0.20%. The preferable range of N content is 0.015 to 0.15%. In the case where it is desired to prevent the decrease in creep rupture strength by restricting the Al and Ti contents, the solid-solution strengthening or the precipitation strengthening of nitrogen may be put to practical use. The range of N content in this case is preferably 0.05 to 0.12%, more preferably 0.07 to 0.12%.

O: 0.02% or Less

O (oxygen) is an impurity element mingled from a raw material or the like when the metal material is melted. If the O content exceeds 0.02%, large amounts of oxide inclusions exist in the steel, so that the workability decreases, and also a flaw may occur on the surface of metal material. Therefore, the upper limit of O content is set at 0.02%.

The metal material in accordance with the present invention contains the aforementioned elements or further contains optional containing element, described later, the balance consisting of Fe and impurities.

The "impurities" described herein refer to components that mixedly enter on account of various factors in the production process, including raw materials such as ore or scrap, when a metal material is produced on an industrial scale, the components being allowed to exist in the range such that they do not an adverse influence on the present invention.

As necessary, or to further improve the strength, ductility, or toughness, the metal material in accordance with the present invention may contain, in addition to the aforementioned alloying elements, by mass %, at least one type of the components selected from at least one group of a first group through a fifth group described below:

first group: Co: 10% or less, second group: Mo: 5% or less, W: 5%, and Ta: 5% or less, third group: B: 0.1% or less, V: 0.5% or less, Zr: 0.5% or less, Nb: 2% or less, and Hf: 0.5% or less, fourth group: Mg: 0.1% or less and Ca: 0.1% or less, fifth group: Y: 0.15% or less, La: 0.15% or less, Ce: 0.15% or less, and Nd: 0.15% or less.

Next, these optionally containing elements are explained.

First group (Co: 10% or less, by mass %)

Co (cobalt) acts to stabilize the austenite phase, so that it can replace some of Ni component. Therefore, cobalt may be contained as necessary. However, if the Co content exceeds 10%, cobalt deteriorates the hot workability. Therefore, when cobalt is contained, the content is 10% or less. From the viewpoint of hot workability, the Co content is preferably 5% or less, more preferably 3% or less. In the case where it is desired to achieve the Co containing effect, 0.01% or more of Co is preferably contained.

Second group (Mo: 5% or less, W: 5% or less, Ta: 5% or less, by mass %)

All of Mo (molybdenum), W (tungsten), and Ta (tantalum) are solid-solution strengthening elements. Therefore, one or more types of these elements may be contained as necessary. However, if the contents of these elements exceed 5%, respectively, the workability is deteriorated and also the structural stability is obstructed. Therefore, the contents of these elements are made 5% or less, respectively. The contents of these elements are preferably 3.5% or less, respectively. In the case where two or more types of these elements are contained, it is preferable that the total content be made 10% or less. In the case where it is desired to achieve the containing effect of Mo, W, or Ta, 0.01% or more of Mo, W, or Ta is preferably contained.

For Mo, W, and Ta, only any one type of these elements can be contained singly, or more types of these elements can be contained compositely. The total content in the case where these elements are contained compositely is made 15% or less. The total content is preferably made 10% or less.

Third group (B: 0.1% or less, V: 0.5% or less, Zr: 0.5% or less, Nb: 2% or less, and Hf: 0.5% or less, by mass %)

B (boron), V (vanadium), Zr (zirconium), Nb (niobium) and Hf (hafnium) are elements effective in improving the high-temperature strength characteristics, so that one kind or more kinds of these elements may be contained. However, when boron is contained, boron deteriorates the weldability if the content exceeds 0.1%. Therefore, the B content is 0.1% or less. The B content is preferably 0.05% or less. When vanadium is contained, vanadium deteriorates the weldability if the content exceeds 0.5%. Therefore, the V content is 0.5% or less. The V content is preferably 0.1% or less. When zirconium is contained, zirconium deteriorates the weldability if the content exceeds 0.5%. Therefore, the Zr content is 0.5% or less. The Zr content is preferably 0.1% or less. When niobium is contained, niobium deteriorates the weldability if the content exceeds 2%. Therefore, the Nb content is 2% or less. The Nb content is preferably 0.8% or less. Also, when hafnium is contained, hafnium deteriorates the weldability if the content exceeds 0.5%. Therefore, the Hf content is 0.5% or less. The Hf content is preferably 0.1%. In the case where it is desired to achieve the containing effect of B, V, Zr, Nb, or Hf, it is preferable that 0.0005% or more of B or Hf be contained, or 0.005% or more of V, Zr, or Nb be contained.

For B, V, Zr, Nb, and Hf, only any one type of these elements can be contained singly, or two or more types of these elements can be contained compositely. The total content in the case where these elements are contained compositely is made 3.6% or less. The total content is preferably made 1.8% or less.

Fourth group (Mg: 0.1% or less and Ca: 0.1% or less, by mass %)

Mg (magnesium) and Ca (calcium) have an effect of improving the hot workability, so that one kind or two kinds of these elements may be contained as necessary. However, when magnesium is contained, magnesium deteriorates the weldability if the content exceeds 0.1%. Therefore, the Mg content is 0.1% or less. Also, when calcium is contained, calcium deteriorates the weldability if the content exceeds 0.1%. Therefore, the Ca content is 0.1% or less. In the case where it is desired to achieve the containing effect of Mg or Ca, it is preferable that 0.0005% or more of Mg or Ca be contained.

For Mg and Ca, only either one type of these elements can be contained singly, or two types of these elements can be contained compositely. The total content in the case where these elements are contained compositely is made 0.2% or less. The total content is preferably made 0.1% or less.

Fifth group (Y: 0.15% or less, La: 0.15% or less, Ce: 0.15% or less, and Nd: 0.15% or less, by mass %)

Y (yttrium), La (lanthanum), Ce (cerium) and Nd (neodymium) have an effect of improving the oxidation resistance, so that one kind or more kinds of these elements may be contained as necessary. However, when these elements are contained, these elements deteriorate the workability if the content of any one element thereof exceeds 0.15%. Therefore, the content of any one element thereof is 0.15% or less. The content is preferably 0.07% or less. In the case where it is desired to achieve the containing effect of Y, La, Ce, or Nd, it is preferable that 0.0005% or more of Y, La, Ce, or Nd be contained.

For Y, La, Ce, and Nd, only any one type of these elements can be contained singly, or two or more types of these elements can be contained compositely. The total content in the case where these elements are contained compositely is made 0.6% or less. The total content is preferably made 0.1% or less.

(B) Concerning Crystal Grain Size of Metal Material

The crystal grain size of metal material is preferably made so fine that the austenite grain size No. is 6 or higher. The grain size No. is preferably 7 or higher, more preferably 7.5 or higher. The reason for this is that as the crystal grain size of austenitic microstructure, which is the base metal, is smaller, the creep ductility is higher, and the HAZ crack susceptibility can be reduced further. The austenite grain size No. is based on the specification of ASTM (American Society for Testing and Material).

In order to make the crystal grain size small, for example, the heat treatment conditions at the time of intermediate heat treatment and final heat treatment has only to be regulated properly, or heat treatment has only to be performed while a strain is given, for example, by increasing the working ratio at high temperatures or at the cold-working time. In this case, precipitates are dissolved by making the intermediate heat treatment temperature higher than the final heat treatment temperature, and thereafter a working strain is imposed at high temperatures or low temperatures, whereby at the final heat treatment time, the nucleation site of recrystallization is increased, and further the compounds having been dissolved is precipitated finely, so that the growth of recrystallized grains is restrained. As a result, the desired fine grain can be formed.

The metal material in accordance with the present invention may be formed into a required shape such as a thick plate, sheet, seamless tube, welded tube, forged product, and wire rod by means of melting, casting, hot working, cold rolling, welding, and the like. Also, the metal material may be formed into a required shape by means of powder metallurgy, centrifugal casting, and the like. The surface of the metal material having been subjected to final heat treatment may be subjected to surface treatment such as pickling, shotblasting, shotpeening, mechanical cutting, grinding, and electropolishing. Also, on the surface of the metal material in accordance with the present invention, one or more irregular shapes such as protruding shapes may be formed. Also, the metal material in accordance with the present invention may be combined with various kinds of carbon steels, stainless steels, Ni-based alloys, Co-based alloys, Cu-based alloys, and the like to be formed into a required shape. In this case, the joining method of the metal material in accordance with the present invention to the various kinds of steels and alloys is not subject to any restriction. For example, mechanical joining such as pressure welding and "staking" and thermal joining such as welding and diffusion treatment can be performed.

Next, the present invention is explained in more detail with reference to examples. The present invention is not limited to these examples.

Example 1

A metal material having a chemical composition given in Table 1 was melted by using a high-frequency heating vacuum furnace, and a metal plate having a plate thickness of 6 mm was manufactured by hot forging and hot rolling. The metal plate was subjected to solid solution heat treatment under the conditions that the heat treatment temperature is 1140 to 1230° C. and the heat treatment time is 4 minutes, and a test piece was prepared by cutting a part of the metal plate. For the metal material of No. 1 given in Table 1, the ASTM grain size No. was changed variously by regulating the heat treatment conditions (sub Nos. a to e). From the metal material described in Table 1, a test piece measuring 3 mm in plate thickness, 15 mm in width and 20 mm in length was cut. This test piece was isothermally maintained at 650° C. in a 45% CO-42.5% $H_2$-6.5% $CO_2$-6% $H_2O$ (percent by volume) gas atmosphere. The test piece was taken out after 200 hours had elapsed, and the presence of a pit formed on the surface of test piece was examined by visual observation and by optical microscope observation. It was judged that the case where no pit occurs satisfies the performance of the present invention. The results are summarized in Table 2.

Referring to Table 2, among the metal materials of Nos. 25 to 36 in which the chemical composition deviated from the conditions defined in the present invention, the metal material of No. 28 in which the Si content deviated from the conditions defined in the present invention, the metal material of No. 29 in which the Cr content deviated from the conditions defined in the present invention, and the metal material of No. 33 in which the Cu content deviated from the conditions defined in the present invention were formed with pits after 200 hours elapsed. Therefore, the metal dusting resistance is poor in a synthetic gas environment containing CO. On the other hand, in all of the metal materials (Nos. 1 to 24) specified in the present invention, no pit is formed, and therefore, these metal materials have excellent metal dusting resistance. The metal materials of Nos. 24 and 25 in which the Cu content deviated from the conditions defined in the present invention will be described later.

TABLE 1

| | | Chemical composition (mass % Balance: Fe and impurities) | | | | | | | | | | | | | |
|---|---|---|---|---|---|---|---|---|---|---|---|---|---|---|---|
| No. | sub No. | C | Si | Mn | P | S | Cr | Ni | Cu | Al | Ti | N | O | Others | ASTM grain size No. |
| 1 | a | 0.063 | 0.97 | 0.81 | 0.018 | 0.0004 | 19.9 | 24.9 | 2.99 | 0.03 | 0.01 | 0.012 | <0.01 | 0.005Ca | 9.5 |
| 1 | b | 0.063 | 0.97 | 0.81 | 0.012 | 0.0004 | 19.9 | 24.9 | 2.99 | 0.03 | 0.01 | 0.012 | <0.01 | 0.005Ca | 8.4 |
| 1 | c | 0.063 | 0.97 | 0.81 | 0.012 | 0.0004 | 19.9 | 24.9 | 2.99 | 0.03 | 0.01 | 0.012 | <0.01 | 0.005Ca | 7.2 |
| 1 | d | 0.063 | 0.97 | 0.81 | 0.012 | 0.0004 | 19.9 | 24.9 | 2.99 | 0.03 | 0.01 | 0.012 | <0.01 | 0.005Ca | 6.3 |
| 1 | e | 0.063 | 0.97 | 0.81 | 0.012 | 0.0004 | 19.9 | 24.9 | 2.99 | 0.03 | 0.01 | 0.012 | <0.01 | 0.005Ca | 5.5 |
| 2 | — | 0.065 | 0.97 | 0.82 | 0.023 | 0.0006 | 19.7 | 25.2 | 3.00 | 0.09 | 0.01 | 0.095 | <0.01 | 0.48Nb, 0.002B, 0.018Ce, 0.008La | 7.8 |
| 3 | — | 0.063 | 0.96 | 0.83 | 0.016 | 0.0004 | 19.9 | 25.1 | 3.01 | 0.03 | 0.006 | 0.112 | <0.01 | 0.98Ta | 8.5 |
| 4 | — | 0.032 | 0.91 | 0.72 | 0.025 | 0.0008 | 19.5 | 24.2 | 2.84 | 0.04 | 0.02 | 0.008 | 0.01 | — | 8.2 |
| 5 | — | 0.058 | 0.93 | 0.83 | 0.015 | 0.0009 | 19.4 | 25.6 | 3.05 | 0.03 | 0.01 | 0.092 | 0.01 | 1.1Mo | 6.4 |
| 6 | — | 0.055 | 0.95 | 0.85 | 0.006 | 0.0024 | 19.8 | 24.3 | 0.72 | 0.04 | 0.02 | 0.015 | 0.01 | 0.0029, 0.06V | 8.6 |
| 7 | — | 0.054 | 1.67 | 1.05 | 0.023 | 0.0007 | 19.7 | 24.2 | 2.97 | 0.03 | 0.01 | 0.024 | <0.01 | 0.003Mg | 9.4 |
| 8 | — | 0.062 | 0.90 | 1.12 | 0.024 | 0.0001 | 19.1 | 29.6 | 2.55 | 0.02 | 0.01 | 0.048 | <0.01 | 0.49Nb | 9.2 |
| 9 | — | 0.063 | 0.92 | 1.15 | 0.021 | 0.0006 | 16.2 | 26.3 | 2.24 | 0.03 | 0.01 | 0.055 | 0.01 | — | 8.4 |
| 10 | — | 0.068 | 1.34 | 1.32 | 0.021 | 0.0004 | 18.5 | 25.0 | 2.68 | 0.05 | 0.02 | 0.090 | 0.02 | 0.8Co, 0.41Nb | 7.7 |
| 11 | — | 0.064 | 1.03 | 0.94 | 0.018 | 0.0008 | 18.2 | 25.4 | 4.25 | 0.04 | 0.05 | 0.025 | <0.01 | 3.4W, 0.04Hf, 0.002Mg | 7.6 |
| 12 | — | 0.062 | 1.19 | 0.83 | 0.019 | 0.0005 | 18.8 | 21.7 | 2.98 | 0.05 | 0.03 | 0.019 | 0.01 | — | 7.8 |
| 13 | — | 0.054 | 1.25 | 0.80 | 0.035 | 0.0002 | 19.2 | 24.9 | 3.11 | 0.04 | 0.02 | 0.140 | 0.01 | 1.3Mo, 2.1W | 8.5 |
| 14 | — | 0.059 | 1.12 | 0.78 | 0.020 | 0.0001 | 19.0 | 25.3 | 3.04 | 0.11 | 0.12 | 0.086 | <0.01 | 0.002B, 0.03Nd | 8.2 |
| 15 | — | 0.062 | 0.98 | 0.75 | 0.020 | 0.0005 | 19.7 | 25.3 | 3.05 | 0.02 | 0.01 | 0.102 | <0.01 | 0.48Nb, 0.003B | 7.7 |
| 16 | — | 0.062 | 0.98 | 0.18 | 0.022 | 0.0006 | 19.6 | 25.4 | 2.78 | 0.07 | 0.01 | 0.065 | 0.01 | — | 8.4 |
| 17 | — | 0.050 | 0.95 | 0.67 | 0.017 | 0.0006 | 19.8 | 26.8 | 2.46 | 0.15 | 0.02 | 0.082 | 0.01 | — | 9.2 |
| 18 | — | 0.061 | 1.05 | 0.60 | 0.026 | 0.0004 | 19.2 | 24.9 | 2.52 | 0.02 | 0.08 | 0.072 | 0.01 | 0.0015B | 8.8 |
| 19 | — | 0.043 | 0.63 | 0.85 | 0.020 | 0.0002 | 19.4 | 25.7 | 2.95 | 0.03 | 0.01 | 0.075 | <0.01 | 0.004Mg, 0.01La , 0.52Ta, 0.03Zr, 1.2Co | 9.0 |
| 20 | — | 0.062 | 0.82 | 0.67 | 0.024 | 0.0002 | 19.8 | 25.0 | 2.68 | 0.006 | 0.01 | 0.034 | <0.01 | 0.03Y, 0.002B, 1.8Mo, 0.003Ca | 8.4 |
| 21 | — | 0.075 | 0.97 | 0.84 | 0.024 | 0.0006 | 19.6 | 25.3 | 3.22 | 0.02 | 0.01 | 0.088 | 0.01 | 0.05Zr, 2.2Mo | 7.2 |
| 22 | — | 0.060 | 1.01 | 0.68 | 0.017 | 0.0120 | 19.2 | 24.3 | 2.87 | 0.05 | 0.05 | 0.075 | 0.01 | 2.5Co | 7.8 |
| 23 | — | 0.070 | 1.05 | 0.70 | 0.014 | 0.0001 | 18.2 | 24.9 | 2.99 | 0.07 | 0.03 | 0.017 | <0.01 | 0.04La | 8.2 |
| 24 | — | 0.061 | 1.02 | 0.78 | 0.018 | 0.0004 | 19.7 | 25.3 | 3.01 | 0.03 | 0.008 | 0.016 | <0.01 | — | 8.5 |
| 25 | — | 0.066 | 1.11 | 0.85 | 0.024 | 0.0007 | 21.7* | 25.2 | 2.88 | 0.01 | 0.03 | 0.005 | 0.01 | — | 9.1 |
| 26 | — | 0.049 | 0.97 | 0.82 | 0.022 | 0.0006 | 20.4* | 25.2 | 3.05 | 0.04 | 0.01 | 0.008 | 0.01 | — | 8.8 |
| 27 | — | 0.085* | 0.92 | 0.84 | 0.022 | 0.0005 | 18.9 | 25.8 | 3.16 | 0.05 | 0.01 | 0.015 | <0.01 | — | 8.4 |
| 28 | — | 0.065 | 0.45* | 0.76 | 0.019 | 0.0006 | 18.7 | 26.2 | 3.08 | 0.04 | 0.02 | 0.072 | <0.01 | — | 8.2 |
| 29 | — | 0.068 | 0.87 | 0.75 | 0.024 | 0.0004 | 16.0* | 26.4 | 3.06 | 0.03 | 0.01 | 0.085 | <0.01 | 0.12Nb | 8.5 |
| 30 | — | 0.054 | 0.89 | 0.68 | 0.024 | 0.0005 | 19.2 | 24.2 | 2.87 | 0.18* | 0.01 | 0.010 | <0.01 | — | 7.7 |
| 31 | — | 0.058 | 0.82 | 0.95 | 0.021 | 0.0002 | 19.0 | 24.1 | 2.88 | 0.03 | 0.21* | 0.012 | <0.01 | — | 8.1 |
| 32 | — | 0.051 | 0.83 | 1.25 | 0.019 | 0.0008 | 22.5* | 23.5 | 2.69 | 0.03 | 0.04 | 0.016 | <0.01 | 1.54Mo | 8.5 |
| 33 | — | 0.049 | 0.95 | 0.65 | 0.019 | 0.0005 | 19.8 | 23.9 | 0.34* | 0.04 | 0.01 | 0.085 | <0.01 | 0.003Mg, 0.002B | 7.6 |
| 34 | — | 0.012* | 1.09 | 0.78 | 0.020 | 0.0006 | 18.3 | 22.9 | 3.22 | 0.03 | 0.01 | 0.072 | <0.01 | 0.005Ca, 0.03Nd | 7.8 |
| 35 | — | 0.072 | 2.14* | 0.85 | 0.021 | 0.0004 | 18.6 | 24.3 | 3.04 | 0.02 | 0.02 | 0.085 | <0.01 | 0.5Co, 0.35Nb | 7.5 |
| 36 | — | 0.17* | 0.97 | 0.50 | 0.021 | 0.0007 | 19.9 | 24.8 | 3.00 | 0.52* | 0.54* | 0.010 | 0.01 | 0.004Ca | 8.6 |

Note:
*shows out of scope of the Invention.

TABLE 2

| No. | Sub No. | 650° C., 200 hr 45% CO-42.5% $H_2$-6.5% $CO_2$-6% $H_2O$ gas Pit observed | 800° C., 40 MPa Creep rupture time (hr) | 800° C., 40 MPa Creep rupture elongation (%) | Restraint welding cracks test Observed HAZ cracks number/observed cross section number | Trans-varestrain test Maximum crack length in welding metal (mm) |
|---|---|---|---|---|---|---|
| 1 | a | No | 1430.7 | 31.4 | 0/10 | 0.6 |
| 1 | b | No | 1530.5 | 31.0 | 0/10 | 0.6 |
| 1 | c | No | 1605.7 | 29.2 | 0/10 | 0.6 |
| 1 | d | No | 1789.7 | 25.9 | 0/10 | 0.6 |
| 1 | e | No | 2001.0 | 23.4 | 0/10 | 0.6 |
| 2 | — | No | 2234.5 | 24.6 | 0/10 | 0.6 |
| 3 | — | No | 2632.5 | 19.5 | 0/10 | 0.6 |
| 4 | — | No | 1340.3 | 36.8 | 0/10 | 0.6 |
| 5 | — | No | 2320.5 | 24.7 | 0/10 | 0.6 |
| 6 | — | No | 1760.0 | 30.3 | 0/10 | 0.6 |
| 7 | — | No | 1630.0 | 33.5 | 1/10 | 1.0 |
| 8 | — | No | 1963.5 | 27.9 | 0/10 | 0.6 |
| 9 | — | No | 1643.8 | 28.9 | 0/10 | 0.6 |
| 10 | — | No | 2309.7 | 21.5 | 0/10 | 0.9 |
| 11 | — | No | 2105.3 | 17.0 | 0/10 | 0.8 |
| 12 | — | No | 1621.0 | 33.3 | 0/10 | 0.6 |
| 13 | — | No | 3250.5 | 18.7 | 0/10 | 0.8 |
| 14 | — | No | 2210.5 | 16.9 | 1/10 | 0.6 |
| 15 | — | No | 2650.4 | 24.6 | 0/10 | 0.6 |
| 16 | — | No | 2001.2 | 17.5 | 0/10 | 0.6 |
| 17 | — | No | 2450.9 | 16.1 | 1/10 | 0.6 |
| 18 | — | No | 2180.8 | 18.5 | 0/10 | 0.6 |
| 19 | — | No | 1980.6 | 36.7 | 0/10 | 0.3 |
| 20 | — | No | 1810.5 | 34.2 | 0/10 | 0.4 |
| 21 | — | No | 2880.5 | 15.3 | 0/10 | 0.9 |
| 22 | — | No | 2450.6 | 24.6 | 0/10 | 0.6 |
| 23 | — | No | 1730.2 | 33.3 | 0/10 | 0.6 |
| 24 | — | No | 1650.3 | 28.7 | 0/10 | 0.6 |
| 25 | — | No | 1130.1 | 32.5 | 0/10 | 0.6 |
| 26 | — | No | 1310.5 | 27.5 | 0/10 | 0.6 |
| 27 | — | No | 3105.8 | 9.7 | 0/10 | 1.4 |
| 28 | — | Yes | 1980.4 | 21.3 | 0/10 | 0.3 |
| 29 | — | Yes | 2320.5 | 27.9 | 0/10 | 0.7 |
| 30 | — | No | 2890.0 | 10.8 | 5/10 | 1.3 |
| 31 | — | No | 2760.5 | 11.1 | 6/10 | 1.3 |
| 32 | — | No | 863.0 | 33.3 | 0/10 | 0.5 |
| 33 | — | Yes | 2124.3 | 30.6 | 0/10 | 0.5 |
| 34 | — | No | 565.3 | 35.3 | 0/10 | 0.2 |
| 35 | — | No | 2345.2 | 8.7 | 10/10 | 2.3 |
| 36 | — | No | 6922.8 | 6.7 | 0/10 | 1.5 |

Example 2

A metal material having a chemical composition given in Table 1 was melted by using a high-frequency heating vacuum furnace, and a metal plate having a plate thickness of 12 mm was manufactured by hot forging and cold rolling. The metal plate was subjected to solid solution heat treatment under the conditions that the heat treatment temperature is 1140 to 1230° C. and the heat treatment time is 5 minutes, and a test piece was prepared by cutting a part of the metal plate. From each of the metal materials given in Table 1, a round-bar test piece having a diameter in parallel portion of 6 mm and a length of 70 mm (parallel portion: 30 mm) was cut out. Also, from the metal plate, a test piece measuring 12 mm in plate thickness, 15 mm in width, and 15 mm in length was cut out. The test piece was embedded in a resin, and the base metal grain size of the structure of the cross section perpendicular to the plate rolling direction was measured, whereby the austenite grain size No. specified in ASTM was determined. The grain size No. is summarized in Table 1. This test piece was held under a stress of 40 MPa at a holding temperature of 800° C., whereby the time up to rupture (creep rupture time) was determined. Further, the test piece elongation up to rupture (creep rupture elongation) was measured. It was judged that the rupture time of 1320 hours or longer satisfies the performance of the present invention. Also, it was judged that the rupture elongation of 15% or more satisfies the performance of the present invention. These results are summarized in Table 2.

Table 2 reveals that among the metal materials of Nos. 25 to 36 in which the chemical composition deviated from the conditions defined in the present invention, the metal materials of Nos. 25, 26 and 32 in which the Cr content deviated from the conditions defined in the present invention and the metal material of No. 34 in which the C content deviated from the conditions defined in the present invention had short creep rupture time and therefore had a poor creep rupture strength. Further, Table 2 reveals that the metal material of No. 30 in which the Al content deviated from the conditions defined in the present invention, the metal material of No. 31 in which the Ti content deviated from the conditions defined in the present invention, the metal material of No. 35 in which the Si content deviated from the conditions defined in the present invention, and the metal material of No. 36 in which all of the C, Al and Ti contents deviated from the conditions defined in the present invention had a small creep rupture elongation and therefore had a poor creep ductility. On the other hand, all of the metal materials of the present invention (Nos. 1 to 24) had the creep rupture strength and the creep ductility satisfying the conditions defined in the present invention, and therefore were excellent in creep properties.

Example 3

Each of the metal materials having the chemical compositions given in Table 1 was melted by using a high-frequency heating vacuum furnace, and was hot-forged and cold-rolled to prepare a metal plate having a plate thickness of 14 mm. The metal plate was subjected to solid solution heat treatment under the conditions that the heat treatment temperature is 1140 to 1230° C. and the heat treatment time is five minutes, and a test piece was prepared by cutting a part of the metal plate. From each of the metal materials given in Table 1, two test pieces each measuring 12 mm in plate thickness, 50 mm in width, and 100 mm in length were prepared. Next, V-type groove having an angle of 30° and a root thickness of 1.0 mm was formed on one side in the longitudinal direction of the test piece. Thereafter, the surroundings of the test pieces were restraint-welded onto a commercially-available metal plate of "SM400C" specified in JIS G3106 (2004), measuring 25 mm in thickness, 150 mm in width, and 150 mm in length, by using a covered electrode of "DNiCrMo-3" specified in JIS Z3224 (1999). Successively, multi-layer welding was performed in the bevel by TIG welding using a TIG welding wire of "YNiCrMo-3" specified in JIS Z3334 (1999) under the condition of heat input of 6 kJ/cm. After the aforementioned welding operation, from each of the welded test pieces, ten test pieces were sampled to observe the cross section microstructure of the joint. The cross section was mirror-polished and etched, and the presence of cracks in the HAZ was observed under an optical microscope having a magnification of ×500. It was judged that the case where the number of cross sections in which HAZ cracks occur is one or less of the ten observed cross sections satisfies the performance of the present invention. The results are summarized in Table 2.

Table 2 reveals that among the metal materials of Nos. 25 to 36 in which the chemical composition deviated from the conditions defined in the present invention, the metal material of No. 30 in which the Al content deviated from the conditions defined in the present invention, the metal material of No. 31 in which the Ti content deviated from the conditions defined in the present invention, and the metal material of No. 35 in which the Si content deviated from the conditions defined in the present invention were formed with HAZ cracks and had a raised HAZ crack susceptibility. On the other hand, among the metal materials of the present invention (Nos. 1 to 24), the metal material of No. 7 in which the Si content is high, the metal material of No. 14 in which the Ti content is high, and the metal material of No. 17 in which the Al content is high satisfied the defined performance of the present invention although HAZ cracks occurred in one observed cross section of the ten cross sections. In the metal materials of the present invention excluding the aforementioned metal materials, HAZ cracks did not occur, and the weldability relating to the HAZ crack susceptibility was excellent.

Example 4

A metal material having a chemical composition given in Table 1 was melted by using a high-frequency heating vacuum furnace, and a metal plate having a plate thickness of 6 mm was manufactured by hot forging and hot rolling. The metal plate was subjected to solid solution heat treatment under the conditions that the heat treatment temperature is 1140 to 1230° C. and the heat treatment time is 4 minutes, and a test piece was prepared by cutting a part of the metal plate. From each of the metal materials given in Table 1, a trans-varestrain test piece measuring 4 mm in thickness, 100 mm in width, and 100 mm in length was prepared. Thereafter, bead-on-plate welding was performed by GTAW under the conditions that the welding current is 100 A, the arc length is 2 mm, and the welding speed is 15 cm/min, and when the molten pool arrives at the central portion in the longitudinal direction of the test piece, bending deformation is given to the test piece and an additional strain is given to the weld metal to produce a crack. The additional strain was made 2% of the saturation of the maximum crack length. In evaluation, the maximum length of the crack occurring in the weld metal was measured, and it was used as a solidification crack susceptibility evaluation index that the welding material had. It was judged that the maximum crack length of 1 mm or shorter satisfies the performance of the present invention. The results are summarized in Table 2.

Table 2 reveals that among the metal materials of Nos. 25 to 36 in which the chemical composition deviated from the conditions defined in the present invention, the metal material of No. 27 in which the C content deviated from the conditions defined in the present invention, the metal material of No. 30 in which the Al content deviated from the conditions defined in the present invention, the metal material of No. 31 in which the Ti content deviated from the conditions defined in the present invention, the metal material of No. 35 in which the Si content deviated from the conditions defined in the present invention, and the metal material of No. 36 in which all of the C, Al and Ti contents deviated from the conditions defined in the present invention showed that the maximum crack length in the weld metal exceeded 1 mm, and therefore had a raised weld solidification crack susceptibility. On the other hand, it is revealed that the metal materials of the present invention (Nos. 1 to 24) showed that the maximum crack length in the weld metal was 1 mm or shorter, and are excellent in weldability relating to the weld solidification crack susceptibility.

INDUSTRIAL APPLICABILITY

There is provided a metal material that has an effect of restraining reaction between carburizing gas and the metal surface, has excellent metal dusting resistance, carburization resistance, and coking resistance, and further has improved weldability and creep ductility. This metal material can be used for welded structure members of cracking furnaces, reforming furnaces, heating furnaces, heat exchangers, etc. in petroleum refining, petrochemical plants, and the like, and can significantly improve the durability and operation efficiency of apparatus.

The invention claimed is:

1. A metal material, consisting of, by mass %, C: 0.032 to 0.075%, Si: 0.63 to 1.67%, Mn: 0.18 to 1.32%, P: 0.035% or less, S: 0.012% or less, Cr: 16.2 to 19.9%, Ni: 21.7 to 29.6%, Cu: 0.72 to 4.25%, Al: 0.15% or less, Ti: 0.12% or less, N: 0.008 to 0.140%, and O (oxygen): 0.02% or less, the balance being Fe and impurities.

2. The metal material according to claim 1,
characterized by having a fine grain size such that the austenite grain size is No. 6 or higher.

3. A metal material, consisting of, by mass %, C: 0.032 to 0.075%, Si: 0.63 to 1.67%, Mn: 0.18 to 1.32%, P: 0.035% or less, S: 0.012% or less, Cr: 16.2 to 19.9%, Ni: 21.7 to 29.6%, Cu: 0.72 to 4.25%, Al: 0.15% or less, Ti: 0.12% or less, N: 0.008 to 0.140%, O (oxygen): 0.02% or less, at least one kind of a component selected from at least one group of the first group to the fifth group described below, and the balance being Fe and impurities:
first group: Co: 10% or less,
second group: Mo: 5% or less, W: 5% or less, and Ta: 5% or less,
third group: B: 0.1% or less, V: 0.5% or less, Zr: 0.5% or less, Nb: 2% or less, and Hf: 0.5% or less,
fourth group: Mg: 0.1% or less and Ca: 0.1% or less,
fifth group: Y: 0.15% or less, La: 0.15% or less, Ce: 0.15% or less, and Nd: 0.15% or less.

4. The metal material according to claim 3,
characterized by having a fine grain size such that the austenite grain size is No. 6 or higher.

5. A metal material, consisting of, by mass %, C: 0.04 to 0.07%, Si: 0.8 to 1.5%, Mn: 0.18 to 1.32%, P: 0.035% or less, S: 0.012% or less, Cr: 18.0% to 19.9%, Ni: 22.0 to 28.0%, Cu: 1.5 to 4.25%, Al: 0.12% or less, Ti: 0.05% or less, N: 0.008 to 0.140%, and O (oxygen): 0.02% or less, the balance being Fe and impurities.

6. The metal material according to claim 5,
characterized by having a fine grain size such that the austenite grain size is No. 6 or higher.

7. A metal material, consisting of, by mass %, C: 0.04 to 0.07%, Si: 0.8 to 1.5%, Mn: 0.18 to 1.32%, P: 0.035% or less, S: 0.012% or less, Cr: 18.0% to 19.9%, Ni: 22.0 to 28.0%, Cu: 1.5 to 4.25%, Al: 0.12% or less, Ti: 0.05% or less, N: 0.008 to 0.140%, O (oxygen): 0.02% or less, at least one kind of a component selected from at least one group of the first group to the fifth group described below, the balance being Fe and impurities:
first group: Co: 10% or less,
second group: Mo: 5% or less, W: 5% or less, and Ta: 5% or less,
third group: B: 0.1% or less, V: 0.5% or less, Zr: 0.5% or less, Nb: 2% or less, and Hf: 0.5% or less,
fourth group: Mg: 0.1% or less and Ca: 0.1% or less, fifth group: Y: 0.15% or less, La: 0.15% or less, Ce: 0.15% or less, and Nd: 0.15% or less.

8. The metal material according to claim 7, characterized by having a fine grain size such that the austenite grain size is No. 6 or higher.

* * * * *